United States Patent [19]

Grabenkort

[11] Patent Number: 4,936,445

[45] Date of Patent: Jun. 26, 1990

[54] CONTAINER WITH IMPROVED RATCHET TEETH

[75] Inventor: Richard W. Grabenkort, Barrington, Ill.

[73] Assignee: Abbott Laboratories, Abbott Park, Ill.

[21] Appl. No.: 420,640

[22] Filed: Oct. 10, 1989

Related U.S. Application Data

[63] Continuation of Ser. No. 138,810, Dec. 28, 1987, abandoned.

[51] Int. Cl.[5] ..... B65D 25/00; B65D 41/06

[52] U.S. Cl. ..... 206/219; 215/330; 215/263; 74/578; 604/410

[58] Field of Search ..... 206/219, 220, 221, 222; 604/410; 74/575, 576, 578; 215/263, 330

[56] References Cited

U.S. PATENT DOCUMENTS

| | | | |
|---|---|---|---|
| 2,423,582 | 7/1947 | Coleman | 215/330 X |
| 3,871,545 | 3/1975 | Bereziat | 215/330 X |
| 4,614,267 | 9/1986 | Larkin | 206/219 X |
| 4,614,515 | 9/1986 | Tripp et al. | 604/403 |
| 4,757,911 | 7/1988 | Larkin et al. | 220/265 |

FOREIGN PATENT DOCUMENTS

| | | | |
|---|---|---|---|
| 1268262 | 6/1961 | France | 215/330 |

*Primary Examiner*—William Price

*Attorney, Agent, or Firm*—Neuman, Williams, Anderson & Olson

[57] ABSTRACT

Improved flexible ratchet teeth are provided for allowing relative rotational movement of one peripheral surface relative to an encompassing peripheral surface. Such teeth allow relative rotational movement in one direction of rotation only during which the ratchet teeth of one peripheral surface slide over the ratchet teeth of the other. The flexible teeth which may be disposed on either or both peripheral surfaces prevent distortion of the encompassing peripheral surface obtained in the prior art when ratchet teeth of solid construction are employed.

15 Claims, 3 Drawing Sheets

CONTAINER WITH IMPROVED RATCHET TEETH

This application is a continuation of application Ser. No. 138,810, filed Dec. 28, 1987, now abandoned.

This invention relates to a dual container system such as a medicament-containing vial and a fluid source having associated means to effect sterile intermixing of the contents of the two containers by external manipulation after the containers are joined while sterility is maintained. More particularly, the invention relates to an improved design of ratchet teeth which circumscribe the interior of a sleeve or port of the fluid source, or the outer periphery of a medicament-containing vial. The teeth of the port engage compatible ratchet teeth which circumscribe the outside of a skirt member of the wall portion of the vial. The improved teeth of this invention may be mounted on either container or both containers of the known dual container system, as will hereinafter be described in greater detail. The ratchet teeth engagement prevents removal of the vial from the fluid source which could destroy the system sterility should the vial be disengaged from the fluid source and then reattached. The improved ratchet teeth ease assembly of the two containers while retaining the same resistance to vial withdrawal as with previous ratchet teeth designs.

In particular, this invention is for use in systems involving packaging of a medicament and a diluent in separate containers which may be connected to one another at the time of use for convenient, safe mixing of the medicament and diluent in a sterile environment. Such container systems are known in the art and currently are sold by Abbott Laboratories of North Chicago, Ill. under the trademark ADD-VANTAGE. A number of embodiments of such systems are disclosed in U.S. Pat. No. 4,614,267 to Larkin and U.S. Pat. No. 4,614,515 to Tripp and Larkin, both of which are assigned to the assignee of this invention. The disclosures of such patents are incorporated herein by reference.

In the noted system a flexible diluent container includes a tubular port or sleeve which provides a means for securing thereto a stoppered medicament vial. Typically the interengagement of the vial and the sleeve of the diluent container is accomplished by threadable engagement of threads circumscribing the outside of the neck portion of the vial defining the vial opening with complementary threads within the diluent container sleeve. Additionally, ratchet teeth which circumscribe the outside of a skirt member which is in frictional engagement with a wall portion of the vial, engage with compatible ratchet teeth located on the interior of the sleeve or port of the fluid source. The slopes of the compatible ratchet teeth are such that once interengagement is begun the vial cannot be backed out of the sleeve without causing visible damage to the vial or port, thereby obviating any contamination which may be occasioned by vial-container disengagement and reengagement by making such disengagement visually evident and obvious. The ratchet teeth in this known system are solid and in the course of the vial-container sleeve engagement effect an interference fit. However, the slopes of the compatible teeth allow relative slidable movement of one set of teeth relative to the other. Such slidable movement of the prior art system necessitates a peripheral enlargement of the diluent container sleeve or port in the course of threading the vial into the diluent bag port.

It is highly desirable to provide a diluent container and or medicament vial with ratchet teeth which provide reliability of engagement between the vial and port of the diluent container. An important feature of this invention is that the provided ratchet teeth are sufficiently flexible so as to result in ease of assembly between the medicament and diluent containers as well as retention of similar desired resistance to threaded disengagement as with previous designs. The improved ratchet teeth hereinafter described eliminate the previous necessity of sleeve stretching or expansion when solid ratchet teeth are employed.

It is therefore an object and advantage of the present invention to provide containers with improved ratchet teeth which have the aforementioned and other capabilities.

SUMMARY OF THE INVENTION

This invention relates to container systems employing a new design of ratchet teeth circumscribing the interior of a port and/or the exterior of a vial so as to enhance the interengagement to be made between the additive container or vial and the port of the diluent container. This is accomplished by a design of flexible ratchet teeth which circumscribe the interior of the sleeve or port of the fluid source and/or the exterior of a medicament vial. The improved ratchet teeth hereinafter described in greater detail may thus be formed on either or both containers of the known dual-container systems. The complementary teeth of the systems hereinafter described employ at least one set of improved ratchet teeth which ease assembly of the two containers while retaining the same resistance to slippage as with previous designs. In this manner the port fluid seal is maintained while the additive vial is threaded into the port of the flexible diluent container.

In the preferred embodiment of this invention the improved ratchet teeth of this invention are flexible and tend to fold or wrap in sliding engagement against compatible ratchet teeth. Thus, if the improved ratchet teeth circumscribe the outside of a skirt member which is securely mounted on the wall portion of the vial, as the vial is rotated and threadably advanced into the seated position within the diluent-container port, the teeth of the vial will flex and be "wrapped" about the periphery of the vial. If the improved teeth are disposed about the interior of the port of the diluent container or fluid source of the dual container system, such teeth will flex and be wrapped about the interior periphery of the port. The provided flexible ratchet teeth reduce the necessary torque involved, thus easing assembly of the two containers and eliminate port distortion or stretching which was previously necessary. The slopes of the compatible ratchet teeth are such that once interengagement has begun, the vial system cannot be backed out of the sleeve without causing obvious visible damage to the port or vial. The flexible ratchet teeth flex open and lock with the compatible ratchet teeth of the mating container member thus preventing teeth slippage upon attempted threaded withdrawal of the vial from the fluid source port.

DESCRIPTION OF THE DRAWINGS For a more complete understanding of the invention, reference will be made to the accompanying drawings wherein:

FIG. 5 is a fragmentary, sectional view, illustrating flexible ratchet teeth made in accordance with this invention, such as those illustrated in FIG. 4 in engagement with solid ratchet teeth disposed about the periphery of a medicament vial or the like;

Figure 5:
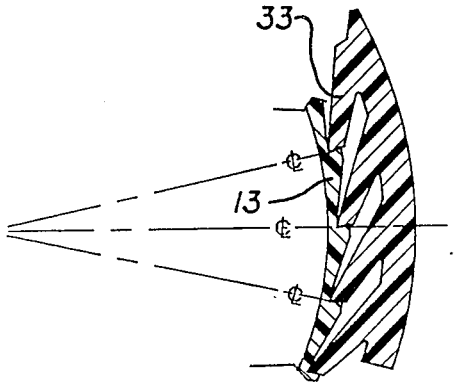
Figure 6:
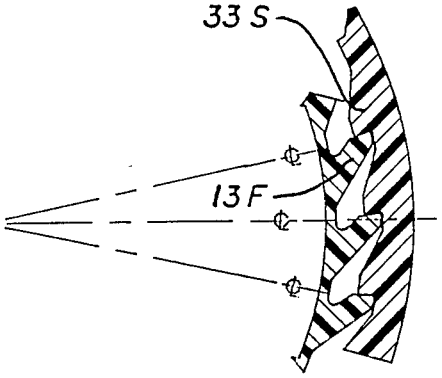
Figure 7:
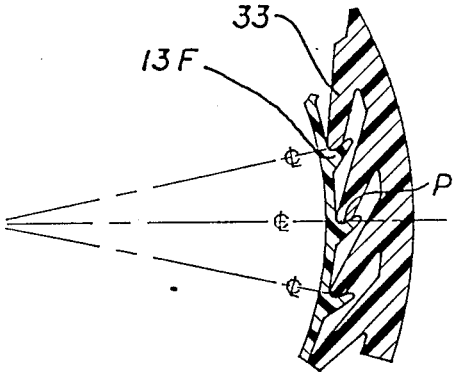

FIG. 6 is a sectional view similar to FIG. 5 illustrating ratchet teeth made in accordance with this invention disposed on a convex surface in engagement with solid ratchet teeth of the prior art, peripherally disposed about a concave surface, and FIG. 7 is a sectional view similar to FIGS. 5 and 6 illustrating compatible flexible teeth made in accordance with this invention, disposed about both a concave outer surface and an convex inner surface.

DESCRIPTION OF THE PREFERRED EMBODIMENT

Figure 1:
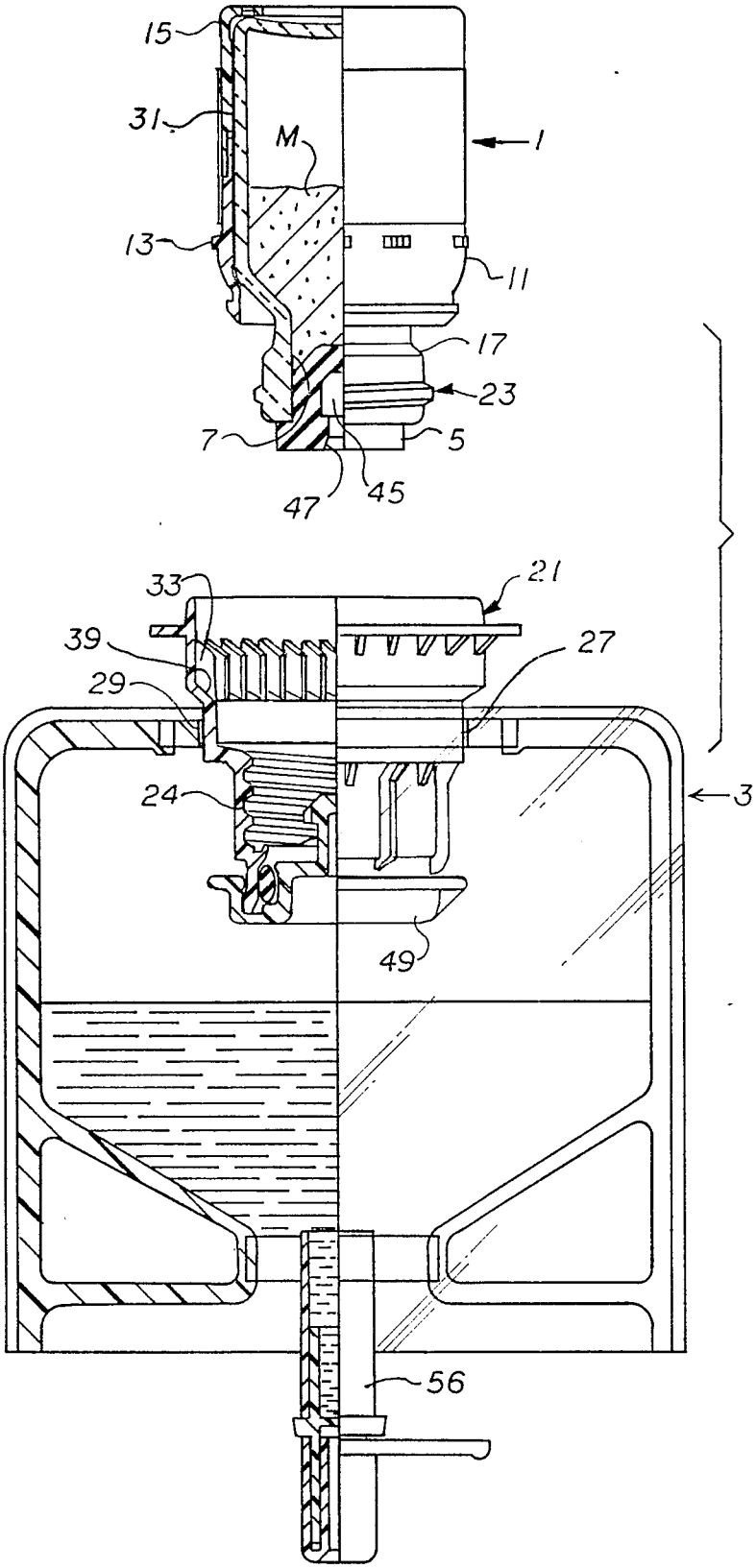
FIG. 1 is a front view, partially in section, of a flexible diluent container made pursuant to this invention and an aligned additive medicament vial prior to engagement.

Proceeding to a detailed description of the illustrated embodiments of the invention, FIG. 1 illustrates an additive medicament vial 1 prior to being secured to flexible diluent container 3. The diluent container 3 typically is supplied with a protective cap over the outer end of port 21 thereof, see for example the closure disclosed in the copending application of Larkin, Tripp and Ziegler, Ser. No. 806,782 filed Dec. 9, 1985 now U.S. Pat. No. 4,757,911 and assigned to the assignee of this invention, the disclosure of which is incorporated herein by this reference. Such a closure comprises no part of this invention and is not shown in FIG. 1, it being assumed that the port has been opened by the health care technician in preparation for engagement of the vial. The additive medicament vial 1 will be supplied independently of the flexible container 3 with the interconnection being effected, for example, by the health care technician. Typically the medicament vial 1 is supplied with a stopper 5 in the vial opening 7 and a removable cap (not illustrated) covering the stopper for maintaining sterility as described in U.S. Pat. No. 4,614,515. The cap is attached to a skirt member 11 which is circumscribed by a ring of ratchet teeth 13 which may be solid and of the type known to the prior art or, made in accordance with this invention.

Figure 2:
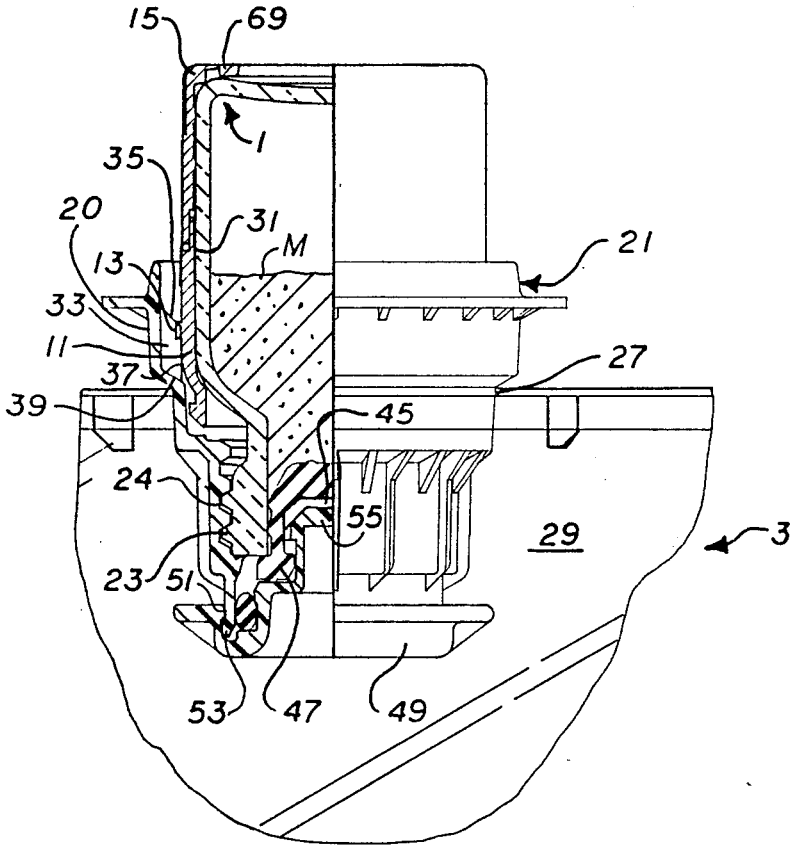
FIG. 2 is an enlarged view, partially in section, showing the vial of FIG. 1 fully engaged with a port portion of the diluent container of FIG. 1 which is fragementarily illustrated.

A shroud 15 covers the lower portion of the vial. The neck having discharge end portion 17 of the vial is exposed for engagement with the diluent container 3 by tearing off a covering cap (not illustrated) along an annular tear line, as described in said U.S. Pat. No. 4,614,515. Once such caps are removed from the vial and the outer end of the port, the vial may be inserted into sleeve or port 21 of the flexible container 3 as illustrated in FIG. 2. Typically, the interengagement of the vial 1 and the sleeve 21 of the diluent container 3 is accomplished by engagement of threads 23 circumscribing the outside portion of the opening 7 of the vial with complementary threads 24 formed on the interior of port 21. The latter is mandrel sealed at 27 to the walls 29 of the flexible container 3. FIG. 2 illustrates such threaded engagement. Ratchet teeth 13 which circumscribe the outside of the skirt member 11 which is in frictional engagement with the wall portion 31 of vial 1, engage with compatible ratchet teeth 33 located on the interior of port 21 of the fluid source 3. The slopes of the compatible ratchet teeth 33 are such that the vial 1 cannot be backed out of the container sleeve without visible evidence of damage, once interengagement is begun, as previously explained above.

FIG. 2 is an enlarged fragmentary view of the engagement of the vial 1 comprising the additive container, and the flexible diluent container after the vial has been inserted into the port 21.

In accordance with this invention, ratchet teeth 33, formed integrally with upper inner, peripheral portion 20 of port 21 which is secured to the diluent container 3 as seen in FIG. 2, are flexible along their length. In addition, it will be noted from FIG. 2 that the upper edge portion of each of the ratchet teeth 33 is downwardly bevelled at 35. It will be further apparent from FIGS. 3 and 4 of the drawing, that the blade-like body of each of the teeth 33 extending from its proximal end slopes in a clockwise direction. As a result, the solid or flexible projecting teeth 13 formed about the outer periphery of the skirt member 11 of the vial 1, will slide over faces 37 of the teeth 33 as the right-hand male threads 23 of the vial 1 threadably engage female threads 24 formed about the lower inner periphery of the port 21 as illustrated in FIG. 1 and FIG. 2. In the course of said threaded engagement, the ratchet teeth 13 of the vial 1 may initially ride down over the upper sloping edges 35 of each of the ratchet teeth 33 of the port 21 prior to engaging a surface 37 of the teeth 33. In the course of such threaded engagement, the teeth 33 will be pushed outwardly toward the inner peripheral wall portion 20 of the port 21 with which said teeth are integrally formed.

Figure 4:
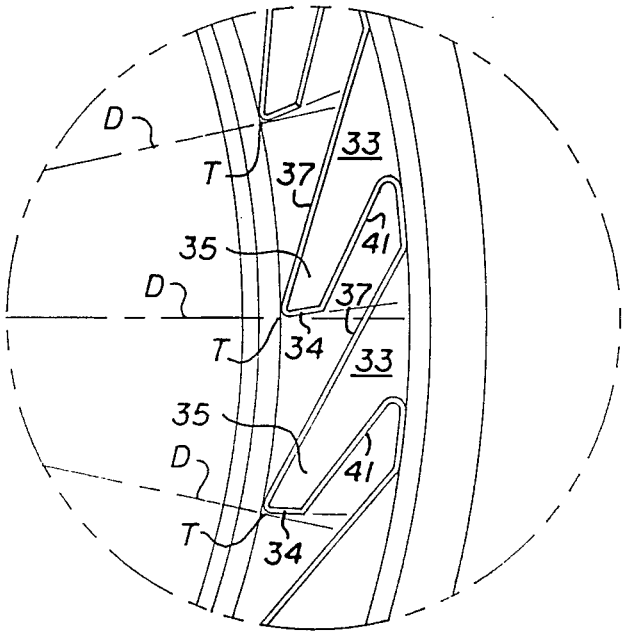
FIG. 4 is an enlarged fragmentary top plan view of one of the flexible ratchet teeth encircled in FIG. 3.

FIG. 5 illustrates the teeth 33 of FIG. 4 in anti-reversing disposition relative to teeth 13 of the vial container illustrated in FIG. 2. In FIG. 5, the teeth 13 are solid and inflexible and of the type known in the prior art.

FIG. 7 is a fragmentary, schematic, sectional view illustrating teeth 33 made in accordance with this invention and disposed about an inner concave peripheral surface and in anti-rotating disposition relative to flexible teeth 13 F illustrated which are also made in accordance with this invention. The teeth 13F are seen to define pockets P for receiving the ends of teeth 33.

FIG. 6 illustrates inner flexible teeth 13F encompassed by solid teeth 33S disposed about a concave surface. Assuming the teeth of FIG. 6. are arranged about vial and port peripheries respectively as above described, teeth 33S may readily flex in normal vial-port threaded engagement, thereby preventing any enlarging forces being imparted to the port periphery. Attempted withdrawal of the vial will result in the condition illustrated in FIG. 6.

As above initially indicated, the flexible ratchet teeth of this invention may be disposed about the outer periphery of vial 1 for purposes of engaging solid complementary ratchet teeth 33*s* of the type known in the prior art. In all three embodiments of FIGS. 5 through 7, the flexible teeth indicated in these three views will function in accordance with this invention even though inter-engaging with complementary ratchet teeth which are solid or which are also made in accordance with this invention.

It will be most apparent from FIG. 4 of the drawing that each flexible tooth made in accordance with this invention, preferably has opposed, converging faces such as converging faces 37 and 41 which terminate at a stop edge surface 34 which interconnects the distal ends of the opposed surfaces 37 and 41. The edges 34 are designed so as to be at an angle of approximately 10°, relative to a diametric line D drawn through the center of the port of which the illustrated threads of FIG. 4 comprise a part, which diametric line is tangential with the terminal end T in FIG. 4 of each tooth base.

It is further preferred that each tooth surface 37 be arranged at an angle of the approximately 73° relative to the aforementioned diametric line passing through the center of the port. Also, it is preferred that the plane of each tooth surface 41 be arranged at an angle of approximately 64° with respect to the diametric line drawn through the center of the port. These angular dispositions are given by way of example only and other angular relationships of the teeth faces which allow desired teeth flexing will also work to advantage.

In the embodiment of FIGS. 1–5, each of the teeth 33 formed integrally with the port 21 is also integrally formed along its bottom edge with a sloping annular ledge portion 39 of the port 21 as seen in FIG. 2. Such junctures assist in maintaining the precise, desired angular disposition of teeth 33. Teeth 13 of FIG. 6 are not anchored at a second edge and are thus "free-standing" as illustrated in FIGS. 6 and 7.

It is apparent that the first-engaged, upper portions of teeth 33 will readily flex upon initial engagement with complementary ratchet teeth 13 of the vial 1 as the threads 23 of the vial proceed downwardly to the fully engaged position illustrated in FIG. 2.

It is further apparent that, should an attempt be made to unscrew the vial 1 from the port 21 from the engaged position of FIG. 2, the solid ratchet teeth 13 of the vial 1 will engage stop surfaces 34 of the teeth 33 in the manner illustrated in FIG. 5. Reverse (counterclockwise) movement of teeth 33, and withdrawal of the vial 1 from the port 21, is prevented once the fully seated relationship of FIG. 2 is attained. Withdrawal of the vial is similarly prevented by teeth 33 prior to attaining the fully seated condition of the vial 1.

It is most apparent from FIGS. 4 and 5 of the drawing that each flexible tooth 33 made in accordance with this invention has a rather elongate base portion, or vertical edge portion, disposed between the opposed tooth planar surfaces 37 and 41, molded integrally with the outer peripheral wall portion 20 of the port 21. As a result, it is a rather easy matter to flex each tooth 33 against the inner periphery of the port with which integrally formed (see FIG. 4). However, upon attempted reverse movement of the vial after initial threaded engagement with the port 21, the solid teeth of the vial in the embodiment at FIG. 5 will engage distal edges 34 of the teeth 33 of the port in the manner illustrated in FIG. 5. The resulting contact and positive stop prevents reverse rotational movement of the vial 1. It will be apparent from FIG. 5 that any reverse torque forces exerted on the vial will be transmitted along the widths of the teeth 33 with substantially no possibility of effecting a flexing of the teeth 33.

In the embodiment of FIG. 7, both the teeth of the vial and the port are flexible so as to facilitate the relative slipping and flexing in the course of threading the vial neck in place with the port 21 of the container 3 to assume the position of FIG. 2. Any attempted reverse movement, however, will result in the stop relationship illustrated in FIG. 7 positively preventing any unthreading action of the vial relative to the port without evident tamper indication, such as label tearing. The vial ratchet teeth and skirt 11 with which such teeth are integrally molded are preferably formed of a more rigid plastic such as polypropylene rather than polyester copolymers from which the port teeth are preferably formed. Thus in the drawing figures, the vial teeth are seen to be smaller than the port teeth. The vial teeth are desirably smaller, being constantly exposed prior to use.

As a result, regardless of the container on which the flexible ratchet teeth of this invention are located, it would be impossible for the vial 3, illustrated in FIG. 2, to be removed from its threaded engagement with the diluent container port 21 so as to allow system contamination without tamper indication.

It will be seen from FIGS. 1 and 2 that stopper 5 which engages the neck of the vial 1 in an airtight engagement, has a recess 45 formed therein defined in part by a ledge 47. It will also be noted from FIGS. 1 and 2 that the bottom portion of the port 21 of the diluent container 3 is covered by a cover 49 having an annular, inwardly-projecting lip 51 which engages a peripheral ledge 53 formed about the lower, outer periphery of the port 21 in fluid-tight engagement. In addition, the cover 49 has an inner protuberance 55 which interlocks in an interference fit within the recess 45 of the stopper 5 of the vial 1 in the manner illustrated in FIG. 2 and which is well known in the art.

The attending health care technician, prior to administration of medicament M contained in the vial 1, will grasp the cover 49 through the pliable outer covering 29 of the diluent container 3, and disengage the cover from the ledge 53 of the port 21 of the diluent container. Simultaneously, the engagement between the protuberance 55 located in the recess 45 of the stopper 5 will pull the stopper 5 free from the inner neck portion of the vial 1, allowing the medicament 1 to enter the diluent contained in container 3. Medicament M of the vial 1 and the diluent of the container 3 may be appropriately mixed by the health care technician, whereafter the freshly prepared solution may be administered to the patient through port 56. The assembly of the vial 1 and container 3, as illustrated in FIG. 2, may be hung from a supporting standard by a pull-out hanger ring 69 formed integrally with plastic shroud 15 disposed in gripping engagement with the cylindrical bottom portion of the vial 1 in the manner illustrated in FIG. 2. The above-described method of stopper removal and ring construction are shown in the prior art as in U.S. Pat. No. 4,614,515.

It is thus seen from the foregoing that novel ratchet teeth have been provided, which are desirably flexible in the course of the threaded engagement of the vial with the port of the diluent container so as to allow ready slippage of the ratchet teeth 13 of the vial over the teeth 33 of the port in the course of engaging the vial and port. However, any attempted retraction or disengagement or counterclockwise movement of the vial 1 relative to the port 21 will result in an interlock between the ratchet teeth 13 formed about the periphery of the vial as the same engage stop surfaces 34 of the port teeth 33.

Figure 3:
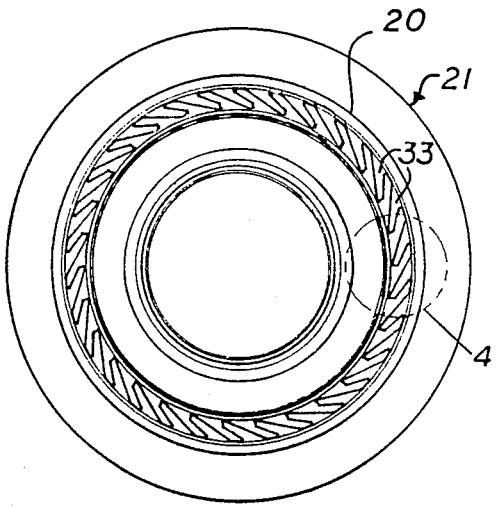
FIG. 3 is a top view of the port of the fluid container.

The foregoing description depicts the ratchet teeth 33 sloping clockwise in the manner illustrated in FIGS. 3 and 4 of the drawing, so as to appropriately function with the clockwise entry of the vial 1 into the port. Obviously, the teeth 33 may be sloped counterclockwise, if for some reason it were desired to provide left-hand threads 23 and mating left-hand female threads 24 on the vial port, respectively, as illustrated in FIG. 2.

Because the ratchet teeth 33 are anchored along their bottom edges by being formed integrally with the sloping annulus 39 illustrated in FIG. 2, the teeth 33 are always assured of being in a precise, vertical, angular disposition, although being able to flex along their length, extending from their bottom connection to the supporting base structure. The teeth, of course, in addition to being formed integrally with the port along their base edges are also formed integrally with the port structure along their inner, proximal or base vertical edges.

The provided flexible teeth may be readily molded from a thermoplastic material, such as a polypropylene copolymer and molded to precise dimensions.

The above-described flexible teeth provide a flexibility not present in prior art teeth which were solid in construction similarly to teeth 13 formed about the vial 1. The benefits of the provided flexibility are more fully appreciated if it is recognized that utilization of solid plastic ratchet systems requires a narrow range of tolerances. The provided flexible teeth of this invention allow a normal range of tolerances to be employed.

The provided teeth may be readily formed in an inexpensive manner, and by virtue of their engagement with the complementary teeth provide for an exceedingly long, vertical area of permissible engagement, greater than that provided by the solid teeth of the prior art.

By way of example, the teeth are preferably formed by molding a desirably flexible copolyester having a typical shore D scale Durometer hardness of about 55 employing ASTM Method D2240, and an ultimate elongation of 380%, and an ultimate tensile strength of 3,500 psi using ASTM method D412. Such plastic also desirably has a flexural modulus using ASTM method D790 of 180,000 psi, and an unannealed compression set using ASTM method D395 (Method B) of 40% at 23° C. and 70% at 70° C. The preferred copolyester has a specific gravity of 1.13 using ASTM method D792.

Also, to facilitate release of the molded teeth 33 from the die in which they are formed, a slight draft of approximately 1° is formed in the die to facilitate release of the teeth which have a corresponding taper. Thus, illustrated on a greatly enlarged scale in FIG. 4, the teeth are seen to slightly enlarge downwardly from the top sloping edge surface 35.

It is believed apparent to those skilled in the art that various changes may be made in structural details of the disclosed invention without departing from the invention disclosed. Thus, although the illustrated teeth disclose teeth sliding surfaces 37 arranged on an angle of approximately 73° relative to the supporting wall from which extended and opposed surfaces 41 arranged at an angle of 61° relative to the supporting port wall surface, it is apparent that other angular dispositions will work to equal advantage. The particular teeth geometry employed is of course dictated, at least in part, by the particular plastic from which such teeth are formed.

It is apparent that the flexible ratchet teeth of this invention, formed on both the medicament vial 1 and diluent bag 3, slope in the permissible direction of rotation of the vial or the bag if the vial or bag is rotated relative to the bag or vial respectively. The slope of the compatible ratchet teeth of the non-rotating member in all embodiments is seen on the other hand, to slope in opposite directions to the permissible directions of rotation to provide the desired slippage and stop actions indicated in the drawing. The above invention is to be limited only by the scope of the appended claims.

What is claimed is:

1. A first container having an access port for interlocking engagement in communicating, complementary relationship with a port of another container having an annular array of ratchet elements therearound; said first container including an annulus, having an annular array of ratchet teeth mounted thereon adapted to allow rotation of said annulus in a first direction of rotation and prevent rotation of said annulus in a second direction of rotation opposite to said first direction relative to such compatible ratchet elements; each of said ratchet teeth of said annular array having flexible blade-like body portion including a proximal end integrally formed with said annulus and being increasingly flexible along its width from its proximal end to its distal end; each of said teeth also being integrally formed at one longitudinal end with said first container whereby each of said teeth is decreasingly flexible along its length as said one longitudinal end is approached; and each of said teeth sloping in said first direction of rotation and being sufficiently flexible so as to avoid the generation of any forces tending to distort said annulus or such mating port in the course of any rotation of said ratchet teeth.

2. The combination of claim 1 in which each of said ratchet teeth has opposed tooth faces of dissimilar widths extending from said proximal end.

3. The combination of claim 2 in which said ratchet teeth blade-like portions are molded integrally with said annulus at said proximal ends.

4. The combination of claim 2 in which the opposed faces of each of said ratchet teeth terminate at an end surface joining said faces and disposed at an acute angle relative to a line drawn through the center of said annulus and tangential with the distal end of the wider face of said blade-like body portion.

5. The combination of claim 4 in which said acute angle is approximately 10°.

6. The combination of claim 1 in which said annulus comprises the concave inner periphery of a threaded port adapted to receive a medicament vial or the like; said port having female threads formed thereon disposed adjacent said ratchet teeth and adapted to engage with male threads of such vial or the like.

7. The combination of claim 1 in which said annulus comprises the convex outer surface of a medicament vial or the like.

8. The ratchet teeth of claims 1, 2, 3, 4, 5, 6, or 7 in which each of said teeth has a sloping edge defining one end thereof.

9. In a threaded port for receiving mating threads of a medicament container of the like, the improvement comprising flexible ratchet means for engaging complementary ratchet teeth of a medicament-containing vial or the like in the course of effecting a threaded engagement with the threads of such port, each of said ratchet means being decreasingly flexible along its length and slidably flexing relative to the ratchet teeth of the vial or the like in the normal course of said threaded engagement; each of said teeth also being integrally formed with said port at a proximal width-defining proximal end and being increasingly flexible along its width to its distal end; said ratchet means assuming a rigid mode when engaged by the ratchet teeth of the vial or the like on attempted threaded disengagement of such vial or the like; flexing of said ratchet means being effected in the absence of any peripheral distortion or enlargement of said threaded port of any peripheral distortion of such medicament-containing vial.

10. In combination, a first plurality of ratchet teeth annularly arranged about the outer periphery of a convex surface; a second plurality of ratchet teeth arranged about the inner periphery of a concave surface encompassing said convex surface; said ratchet teeth of said concave and convex surfaces being so compatible that each of said peripheries may rotate in one permissible direction of rotation relative to the other; the two permissible directions of rotation being opposite to each other; said ratchet teeth being arranged on their respective peripheries so as to slope in their permissible direction of rotation; said ratchet teeth being so compatible that said ratchet teeth of said two peripheries are in slipping engagement during permissible rotation thereof and each peripheral surface is prevented from rotating relative to the other peripheral surface when rotated in a direction of rotation opposite to its permissible direction of rotation; each of said ratchet teeth of at least one of the peripheral surfaces being anchored at proximal width-defining and length-defining ends so as to be increasingly flexible along both its length and width whereby it is sufficiently flexible to avoid the generation of any forces on the convex peripheral surface and the encompassing concave peripheral surface tending to distort the peripheries thereof in the course of any rotation of said ratchet teeth.

11. The combination of claim 10 in which the ratchet teeth arranged about the periphery of said convex surface are free standing.

12. The combination of claim 10 in which the ratchet teeth arranged about the periphery of said concave surface are flexible and fixedly positioned at one longitudinal edge.

13. The combination of claim 12 in which the ratchet teeth are blade-like and arranged about the inner periphery of a cylindrical port; said teeth having opposed planar surfaces of dissimilar width joined by a terminal edge surface interconnecting said planar surfaces; said edge surface being arranged at an acute angle relative to an axis drawn through the center of the cylindrical port and targential with the distal edge of the wider tooth surface

14. In combination, a first container having a access port for interlocking engagement in communicating, complementary relationship with a mating port of a second container, said second container having an annular array of ratchet elements disposed about the outer periphery thereof; said first container mating port having an annular array of ratchet teeth mounted about the inner periphery thereof which are adapted to allow rotation of said second container upon mating engagement with said ratchet elements in a first direction of rotation and prevent rotation of said second container and ratchet elements in a second direction of rotation opposite to said first direction relative to such first container and ratchet teeth; each of said ratchet teeth of said first container having a flexible blade-like body extending from a proximal end formed integrally with said mating port and being of decreasing thickness across its width from its proximal end to its distal end whereby each ratchet tooth is increasingly flexible across its width from its proximal end to its distal end; each of said teeth being integrally formed at one longitudinal end with said first container whereby each of said teeth is decreasingly flexible along its length as said one longitudinal end is approached; and each of said teeth sloping in said first direction of rotation and being sufficiently flexible so as to avoid the generation of any forces tending to distort said second container or said mating port in the course of any relative rotation between said ratchet teeth and said ratchet elements.

15. The combination of claim 14 in which said ratchet elements of said second container are of the same structure as the flexible teeth of said first container and similarly integrally formed with said second container; said ratchet elements sloping in the second direction of rotation.

* * * * *